US011008775B2

(12) United States Patent
Chaffin et al.

(10) Patent No.: US 11,008,775 B2
(45) Date of Patent: May 18, 2021

(54) LIFT GLIDE DOOR LOCK ASSEMBLY AND LIFT GLIDE WINDOW LOCK ASSEMBLY AND DUAL LIFT GLIDE DOOR LOCK ASSEMBLY AND DUAL LIFT GLIDE WINDOW LOCK ASSEMBLY

(71) Applicants: Lawrence E Chaffin, Palestine, TX (US); John R Glover, Palestine, TX (US)

(72) Inventors: Lawrence E Chaffin, Palestine, TX (US); John R Glover, Palestine, TX (US)

( * ) Notice: Subject to any disclaimer, the term of this patent is extended or adjusted under 35 U.S.C. 154(b) by 324 days.

(21) Appl. No.: 16/196,929

(22) Filed: Nov. 20, 2018

(65) Prior Publication Data

US 2019/0085593 A1 Mar. 21, 2019

Related U.S. Application Data

(63) Continuation-in-part of application No. 15/611,241, filed on Jun. 1, 2017, now abandoned, which is a (Continued)

(51) Int. Cl.

| | |
|---|---|
| ***E05D 15/56*** | (2006.01) |
| ***E05B 17/00*** | (2006.01) |
| ***E05C 9/02*** | (2006.01) |
| ***E05B 65/08*** | (2006.01) |
| *E05D 15/06* | (2006.01) |

(Continued)

(52) U.S. Cl.

CPC ..... *E05B 17/0033* (2013.01); *E05B 65/0876* (2013.01); *E05C 9/021* (2013.01); *E05D 15/565* (2013.01); *E05B 65/0811* (2013.01); *E05D 15/0608* (2013.01); *E05D 15/0691* (2013.01); *E05F 1/16* (2013.01); *E05F 11/14* (2013.01); *E05Y 2201/22* (2013.01); *E05Y 2201/426* (2013.01); *E05Y 2201/716* (2013.01); *E05Y 2201/722* (2013.01); *E05Y 2900/132* (2013.01); *E06B 3/52* (2013.01)

(58) Field of Classification Search

CPC ..... E05B 17/0033; E05D 15/565

See application file for complete search history.

(56) References Cited

U.S. PATENT DOCUMENTS 2,643,906 A * 6/1953 Way ..... E05B 83/04 292/341.17
3,168,355 A * 2/1965 Rudolph ..... E05D 15/0691 49/414

(Continued)

FOREIGN PATENT DOCUMENTS

CH 416363 A 6/1966
DE 612641 C * 4/1935 ..... E05D 15/565

(Continued)

*Primary Examiner* — Catherine A Kelly
(74) *Attorney, Agent, or Firm* — Patenttm.US

(57) ABSTRACT

Hardware for a lift glide door assembly and lift glide window assembly provides ease of opening with an operational opening assist that urges the door or window to an open position on operation of an opening handle by use of a cable drive system. A lock mechanism actuates a lock pin, blocks opening gear mechanisms from operating and extends a security bolt for locking. A guide blade is provided for assisting the door during opening or closing operations.

6 Claims, 15 Drawing Sheets

Related U.S. Application Data continuation-in-part of application No. 15/367,098, filed on Dec. 1, 2016, now Pat. No. 10,526,829.

(60) Provisional application No. 62/262,791, filed on Dec. 3, 2015.

(51) Int. Cl.

| | |
|---|---|
| *E06B 3/52* | (2006.01) |
| *E05F 11/14* | (2006.01) |
| *E05F 1/16* | (2006.01) |

(56) References Cited

U.S. PATENT DOCUMENTS

| | | | | |
|---|---|---|---|---|
| 3,172,145 | A * | 3/1965 | Miller | E05D 15/0691 16/87 R |
| 4,891,911 | A | 1/1990 | Yung | |
| 5,018,373 | A | 5/1991 | Weinerman et al. | |
| 5,069,492 | A | 12/1991 | Tatham | |
| 5,469,661 | A * | 11/1995 | Finkelstein | E05B 17/0033 49/235 |
| 5,566,505 | A * | 10/1996 | Kamezaki | E05D 15/1021 49/225 |
| 5,742,979 | A | 4/1998 | Garcia-Hernando | |
| 6,264,252 | B1 | 7/2001 | Clancy | |
| 6,394,510 | B1 | 5/2002 | Stewart, III | |
| 6,945,572 | B1 | 9/2005 | Hauber | |
| 6,981,724 | B2 | 1/2006 | Denys | |
| 7,543,409 | B2 * | 6/2009 | Higashitani | E05B 1/0046 49/276 |
| 7,568,311 | B2 | 8/2009 | Shivak et al. | |
| 7,775,563 | B2 | 8/2010 | Liang et al. | |
| 7,946,080 | B2 * | 5/2011 | Ellerton | E05C 7/04 49/395 |
| 7,971,392 | B2 * | 7/2011 | Seo | E05D 15/565 49/221 |
| 8,083,269 | B2 * | 12/2011 | Mitchell | E05B 17/0033 292/52 |
| 8,122,644 | B2 * | 2/2012 | Jarolim | E05D 15/1068 49/209 |
| 8,240,089 | B2 * | 8/2012 | Lambertini | E05D 15/565 49/425 |
| 8,381,444 | B1 | 2/2013 | McDonald et al. | |
| 8,381,445 | B2 | 2/2013 | Hans | |
| 10,155,460 | B2 * | 12/2018 | Schug | E05B 85/26 |
| 10,526,829 | B2 * | 1/2020 | Chaffin | E05D 15/565 |
| 10,684,063 | B2 * | 6/2020 | Querfurth | E05B 7/00 |
| 2004/0163317 | A1 * | 8/2004 | Reich | E05D 15/565 49/209 |
| 2004/0212198 | A1 | 10/2004 | Glover | |
| 2009/0044916 | A1 | 2/2009 | Singiser et al. | |
| 2009/0199485 | A1 * | 8/2009 | Glover | E05D 15/0669 49/411 |
| 2010/0164237 | A1 | 7/2010 | Brandt | |
| 2011/0203075 | A1 | 8/2011 | Iwaki | |
| 2011/0283621 | A1 | 11/2011 | Glover | |
| 2013/0019438 | A1 | 1/2013 | Tanno et al. | |
| 2013/0104339 | A1 | 5/2013 | Shimizu | |
| 2017/0159325 | A1 * | 6/2017 | Chaffin | E05B 17/0033 |
| 2017/0275916 | A1 * | 9/2017 | Chaffin | E05D 15/565 |

FOREIGN PATENT DOCUMENTS

| | | | | |
|---|---|---|---|---|
| DE | 1187152 | B * | 2/1965 | E05D 15/565 |
| DE | 1808276 | A1 * | 5/1970 | E05D 15/565 |
| EP | 0012453 | A1 * | 6/1980 | E05D 15/063 |
| EP | 1728956 | A1 * | 12/2006 | E05D 15/565 |
| EP | 2476829 | A2 * | 7/2012 | E05D 15/565 |
| EP | 3135842 | A1 * | 3/2017 | E05B 65/08 |
| FR | 1359318 | A * | 4/1964 | E06B 3/4609 |
| FR | 2138420 | A1 * | 1/1973 | E06B 3/4609 |
| FR | 2244366 | A5 * | 4/1975 | E05D 15/565 |
| GB | 2134968 | B | 12/1986 | |
| JP | 2010174476 | A * | 8/2010 | E05D 15/0656 |
| KR | 20080036417 | A * | 4/2008 | E05C 9/24 |
| WO | WO-2007073027 | A1 * | 6/2007 | E05C 9/24 |
| WO | WO-2011077727 | A1 * | 6/2011 | E05B 65/0841 |
| WO | WO-2012172734 | A1 * | 12/2012 | E05B 65/0841 |
| WO | WO-2017026592 | A1 * | 2/2017 | E05B 17/0033 |

* cited by examiner 200
186
204
202
198
206

194
206
196
188
192
182A
184
182
190
180

B
C
192

LIFT GLIDE DOOR LOCK ASSEMBLY AND LIFT GLIDE WINDOW LOCK ASSEMBLY AND DUAL LIFT GLIDE DOOR LOCK ASSEMBLY AND DUAL LIFT GLIDE WINDOW LOCK ASSEMBLY

CROSS-REFERENCE TO RELATED APPLICATIONS

This application is a continuation-in-part of U.S. patent application Ser. No. 15/611,241 filed Jun. 1, 2017, which is a continuation-in-part of U.S. patent application Ser. No. 15/367,098 filed Dec. 1, 2016, which claims benefit of U.S. provisional patent application Ser. 62/262,791, filed Dec. 3, 2015, the disclosures of which are incorporated herein by reference.

BACKGROUND

This disclosure relates to gliding doors and windows, and more particularly to lift glide door and window lock assemblies.

SUMMARY

In accordance with the disclosure, a lift glide door lock assembly is provided, and a lift glide window lock assembly. Further, dual lift glide door and window assemblies are provided.

With larger sliding doors and windows, the weight of the door or window increases, requiring more effort to move the door or window open.

Both the organization and method of operation, together with further advantages and embodiments thereof, may best be understood by reference to the following description taken in connection with accompanying drawings.

DETAILED DESCRIPTION

The system according to a preferred embodiment of the present disclosure comprises a door and a window lock assembly for lift glide doors and windows.

Figure 1:
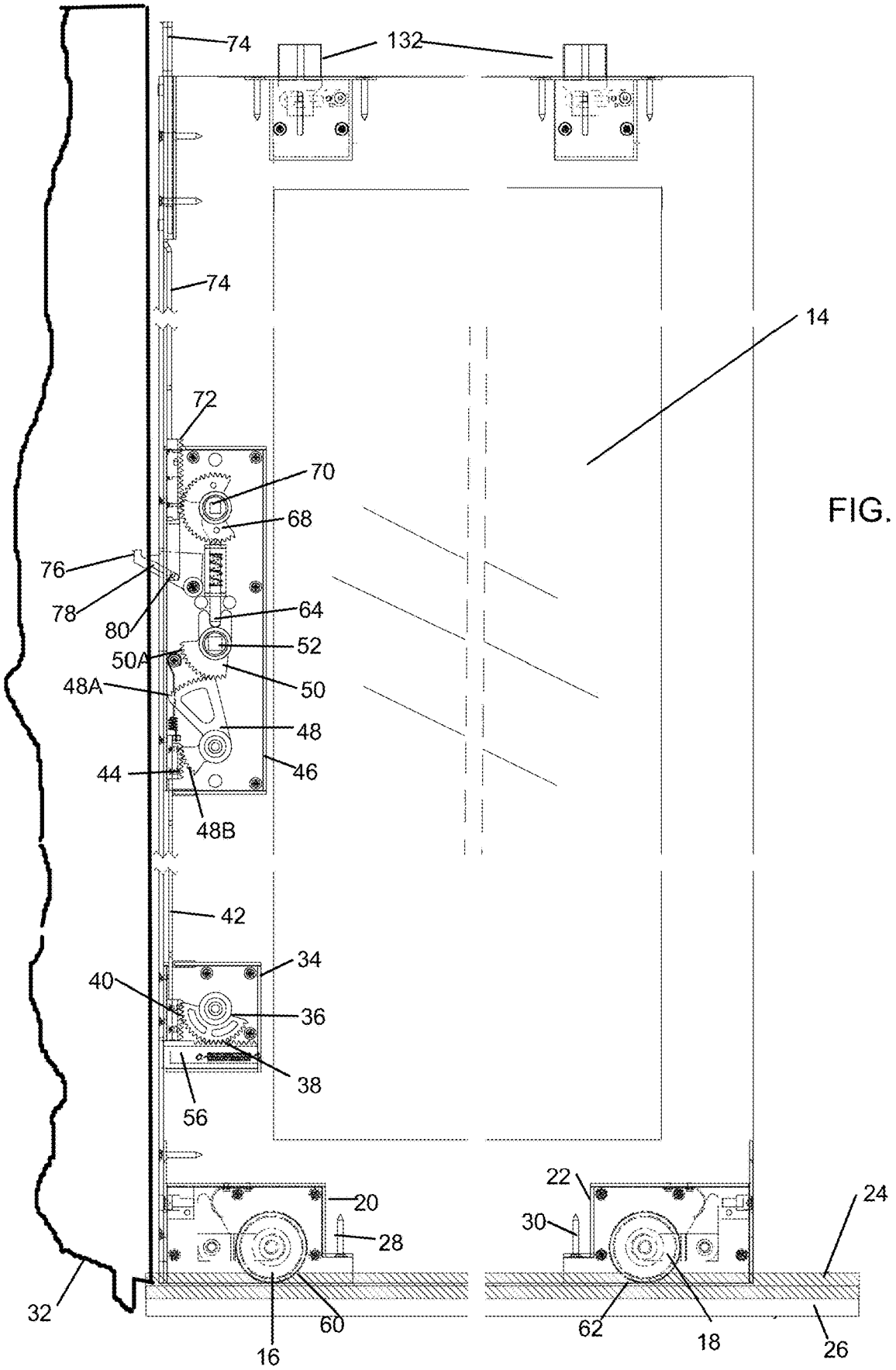
FIG. 1 is a side view of a lift glide door lock assembly in a closed and locked configuration.
Figure 2:
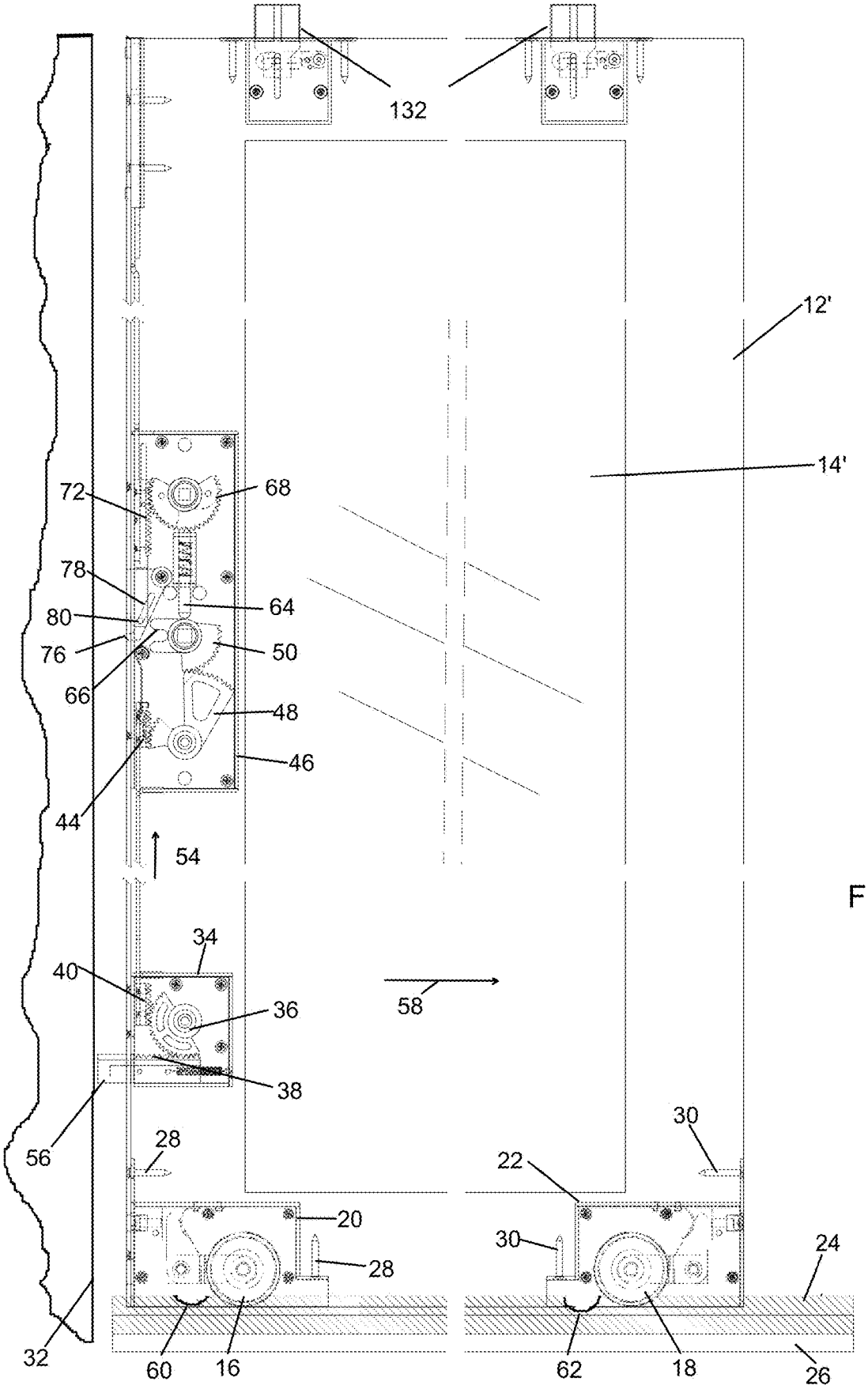
FIG. 2 is a side view of the lift glide door lock assembly in an open configuration.

Referring to FIG. 1, a side view of a lift glide door lock assembly in a closed and locked configuration, and FIG. 2, a side view of the lift glide door lock assembly in an open configuration, the door 10 comprises a frame 12, which is rectangular in shape in the illustrated embodiment, the frame supporting a glass panel 14. Door operational hardware is mounted to the frame as will now be described. A left and right roller 16, 18 are rotationally supported in roller boxes 20, 22, mounted at the left and right lower ends of the door. The rollers are designed to fit over and roll on a roller track 24 mounted to the door sill 26. In the door closed position, the rollers are seated within wells 60, 62 defined in the roller track, which allows the door to lower slightly as it closes, enabling engagement with a perimeter door seal. The roller boxes suitably fit within receiving portions defined in the door frame, and may be secured to the frame by fasteners 28, 30, which might comprise screws. The frame is constructed of wood or plastic or other suitable material that provides sufficient support and rigidity to operate as a door frame.

To the left of the door panel in FIG. 1, is a door jamb 32, which may be defined as part of a wall in which the door opening is made. Along the left edge of the door, positioned above roller box 20, is a push pin case 34, which fits into the door in an opening sized to receive the push pin case. A driving gear 36 is mounted within the push pin case, the teeth of the driving gear interacting with a push pin rack gear 38 and a pull bar rack gear 40. The pull bar rack gear is mounted at a lower end of a pull bar 42 which extends upwardly near the left edge of the door to a second pull bar rack gear 44 which is mounted to the upper end of the pull bar. A lift gear case 46 is positioned within the door, approximately mid-height of the door in the illustrated embodiment, and holds therein a lift gear 48, and a drive gear 50. Drive dear 50 receives a square cross section drive shaft 52 (which is driven by operation of an opening handle to turn the drive gear counterclockwise for opening). A pair of guide blade assemblies 132 are provided at the top of the door to follow a track defined above the door, guiding the door as it moves and maintaining the door in position.

Referring to FIGS. 1 and 2 together, rotation of the drive shaft 52 counterclockwise causes gear 50 to rotate, and the gear teeth 50A, which mesh with gear teeth 48A of lift gear 48, are thereby driven in a clockwise direction, causing lower gear teeth 48B to also rotate, which by interaction with pull bar rack gear 44, causes the pull bar 42 to move upwardly in the direction of arrow 54. The upward movement of the pull bar causes pull bar rack gear 40 to also move upwardly, thereby rotating driving gear 36 clockwise, which by interacting with push pin rack 38, causes push pin 56 to extend towards the door jamb, thereby pushing against the jamb and urging the door to open towards the right, in the direction of arrow 58.

The rollers 16, 18 are moved up out of the wells 60, 62, thus disengaging the entire perimeter weather seal allowing for immediate release of all weather seal contact, allowing the door to move freely with zero weather seal contact.

Locking of the door of FIGS. 1 and 2 is accomplished by a series of lock components, which include a spring loaded locking pin 64 adapted to be received into locking pin slot 66 defined in drive gear 50. A locking gear 68 is positioned within lift gear case 46, with central drive shaft 70 controlling rotation of the gear. The drive shaft is rotated by the turning of a thumb lock control handle 112 shown in FIG. 6. Locking gear 68 drives a security bolt rack gear 72 which is mounted to security bolt 74, bolt 74 extended upwardly to the top of the door and extending into a bolt receiving portion defined in the upper door jamb when in the locked position. A door latch 76 is pivotally mounted within the lift gear case, mounted to security bolt rack gear 72 by pin 80 which rides in slot 78 of the latch. The security bolt and latch are activated simultaneously.

When in the locked configuration of FIG. 1, pin 64 is received in slot 66 of the drive gear 50, preventing the drive gear from turning and thereby preventing opening of the door. Latch 76 is extended and is engaging a keeper defined in the door jamb, further locking the door. Finally, security bolt 74 is extended into a receiver defined in the ceiling of the door jamb, further locking the door against movement.

To open the door, locking gear 68 is rotated by the counterclockwise rotation of drive shaft 70, causing the gears of locking gear 68 to pull rack 72 downwardly, thereby pulling security bolt 74 downwardly, causing pin 80 to move down which then travels in slot 78 to cause latch 76 to rotate counterclockwise and retract. Pin 64 is simultaneously pulled upwardly, out of engagement with slot 66 so that drive gear 50 can then rotate if desired.

In use, the door panel shown can be installed with a non-moving panel of similar size, wherein when open, the moving door slides along side the non-moving panel, to provide an open door on one side, and a pair of glass panes on the other side, so that it is still possible to view through both the opening and the 2 panel side. When closing, the moving panel is slid back towards the closed position, whereupon when the rollers reach the depressions in the roller track, the door drops down slightly and seals against the weather seal around the perimeter of the door.

Figure 3:
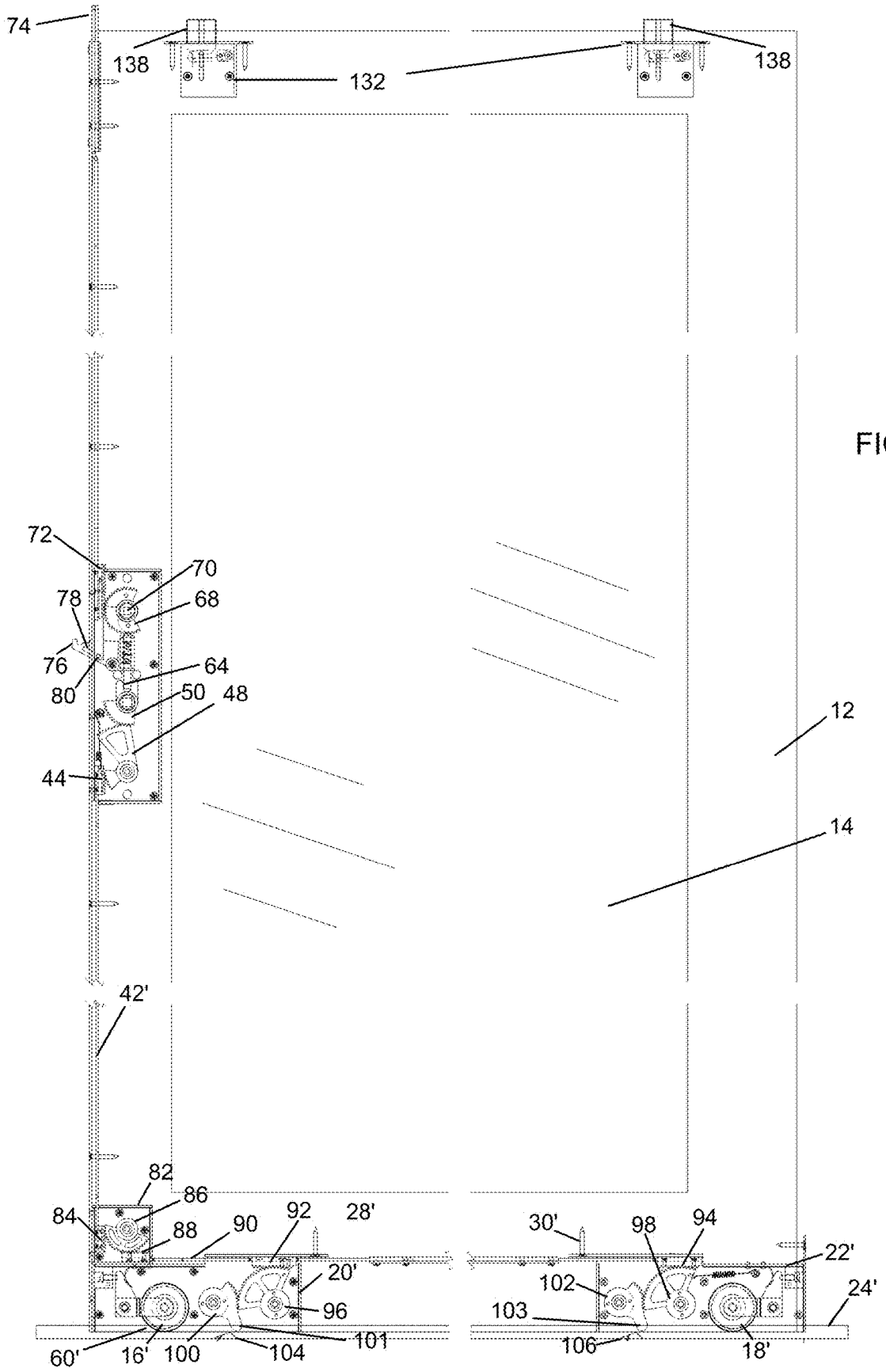
FIG. 3 is a side view of a dual lift glide door assembly in a closed and locked configuration.
Figure 4:
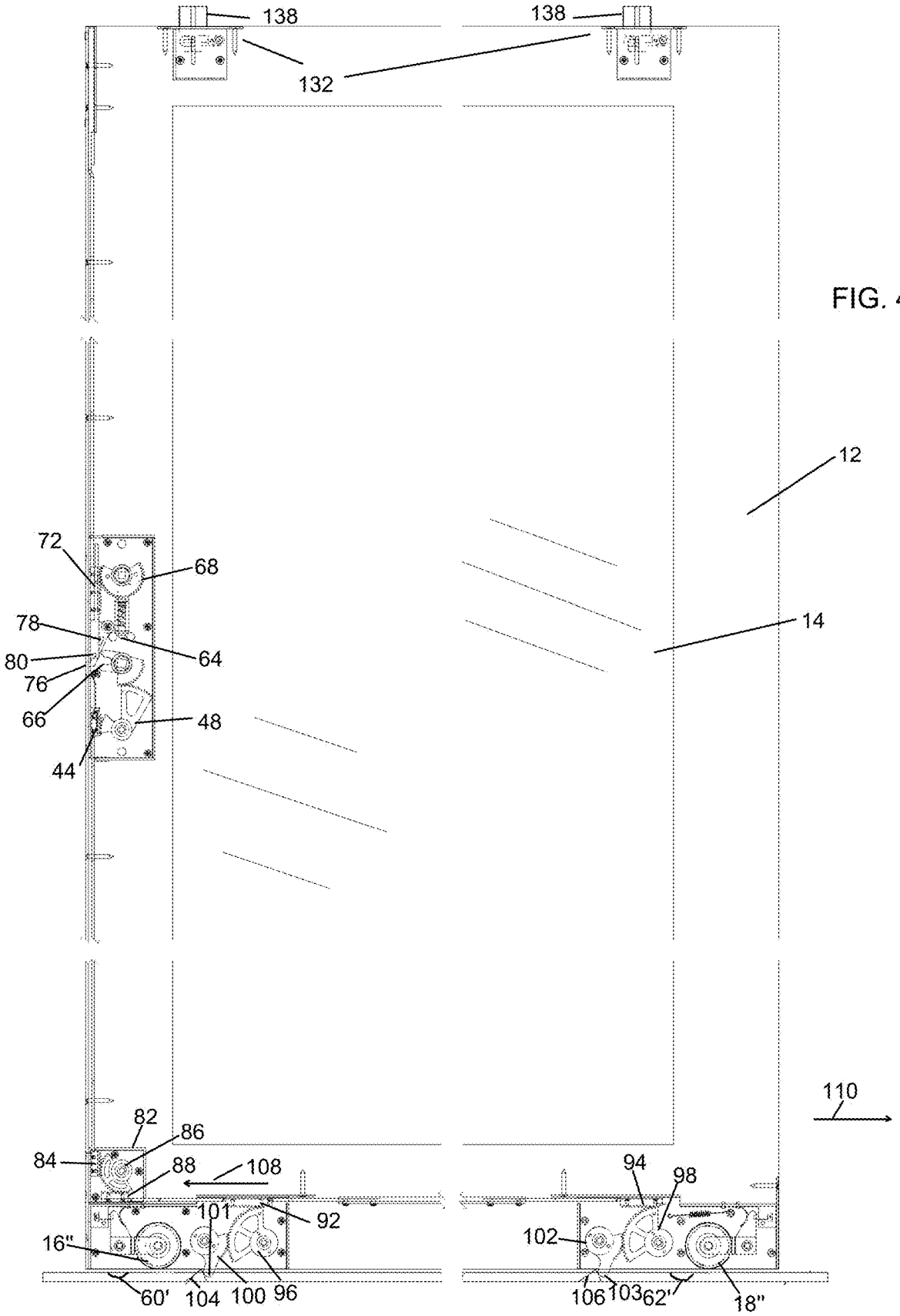
FIG. 4 is a side view of the dual lift glide door assembly in an open configuration.
Figure 5:
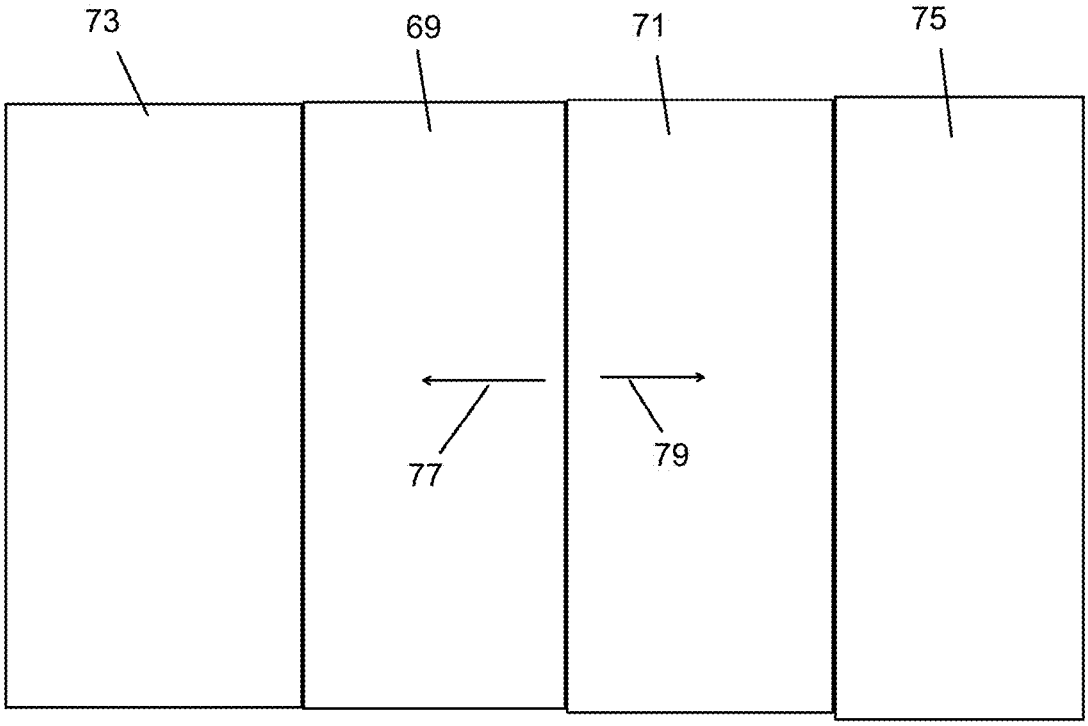
FIG. 5 is a schematic view of a dual gliding door installation.

FIGS. 3 and 4 illustrate a door for use in a dual lift glide door system, wherein the view in FIGS. 3 and 4 is of a right lift glide door, and a second left lift glide door would be provided, in a typically 4 pane configuration illustrated graphically in FIG. 5, where the 2 middle panels 68 and 70 are the gliding doors, and the left most and right most panels 73, 75 are the stationary panes that the gliding doors slide past when opening. Door panels 69 and 71 operatively move in the direction of arrows 77, 79 to open, providing a wide opening. To close, doors 73 and 75 are moved opposite the direction of arrows 77 and 79. In this configuration, the door jamb is not available to push against for opening assist, as the gliding panels are nowhere near the jamb when closed. Accordingly an alternative configuration is provided.

In the configuration of FIGS. 3 (closed state) and 4 (open state), which illustrate one of the dual gliding door configurations (the other of the pair of doors would be substantially a mirror image) the locking and opening handle mechanisms correspond to those of the FIGS. 1 and 2 configuration. However, the lower mechanisms of the doors are of different construction and operate differently. The push pin case 34 and its components are not present in this configuration, since no stationary door jamb is available to push against. Instead, a transfer case 82 is positioned near the bottom of the left edge of the door, the transfer case having a pull bar rack gear 84 mounted to pull bar 42', which operates transfer gear 86. Drive gear 86 interacts with horizontal rack gear 88 mounted on horizontal pull bar 90, positioned above left roller box 20'. Roller boxes 20' and 22' have rollers 16', 18' mounted therewithin, the rollers riding on roller track 24' in the door sill. A horizontal rack gear 92 and horizontal rack gear 94 are mounted to horizontal pull bar 90, at roller boxes 20', 22', and interact with power drive gears 96, 98 mounted in roller boxes 20', 22'. Power drive gears 96, 98 interact with counterpart gear teeth on motion gears 100, 102 inside the respective roller boxes. Motion gears 100, 102 have push finger portions 101, 103.

Positioned on the roller track in the sill, are a pair of push pads 104, 106, situated below the motion gears 100, 102, such that push finger portions defined on the motion gears rest at or near the surface of the push pads when the door is in a closed position. The push pads are suitably located with one to the left of center on the roller track, and the other to the right of center on the roller track.

Referring now to FIGS. 3 and 4 together, the opening operation of the door will be described. As the door opening handle is turned counterclockwise, lift gear 48 is rotated clockwise, much as in the case of the door of FIGS. 1 and 2, which pulls pull bar 42' up, rotating the transfer gear 86 clockwise via the interaction with rack gear 84. This rotation of transfer gear 86, through interaction with rack gear 88 drives horizontal pull bar 90 to the left (in the present figure) in the direction of arrow 108, which translates rack gears 92 and 94 to the left, causing gears 96 and 98 to rotate counterclockwise, driving motion gears 100 and 102 clockwise, which causes the push finger portions 101, 103 of the motion gears to push against push pads 104, 106, causing the door to move up and to the right, in the direction of arrow 110, towards the open position, raising rollers 16', 18' out of the wells in the roller track. This provides an assist to open the door. The left and right of center positioning of the push pads ensures that the door is urged in a straight manner along the center line of the roller track, to remove the likelihood of the door binding. In addition, the counterclockwise rotation of the handle provides an upward movement component, giving an additional amount of urging the door toward the open direction, also providing some additional upward urging of the door up from the seated position.

In FIGS. 3 and 4 a left and right roller 16', 18' are rotationally supported in roller boxes 20', 22', mounted at the left and right lower ends of the door. The rollers are designed to roll on a roller track 24 mounted to the door sill 26. In the door closed position, the rollers are seated within wells 60', 62' defined in the roller track, which allows the door to lower slightly as it closes, enabling engagement with a perimeter door seal. The roller boxes suitably fit within receiving portions defined in the door frame, and may be secured to the frame by fasteners 28', 30', which might comprise screws. The frame is constructed of wood or plastic or other suitable material that provides sufficient support and rigidity to operate as a door frame.

Figure 6:
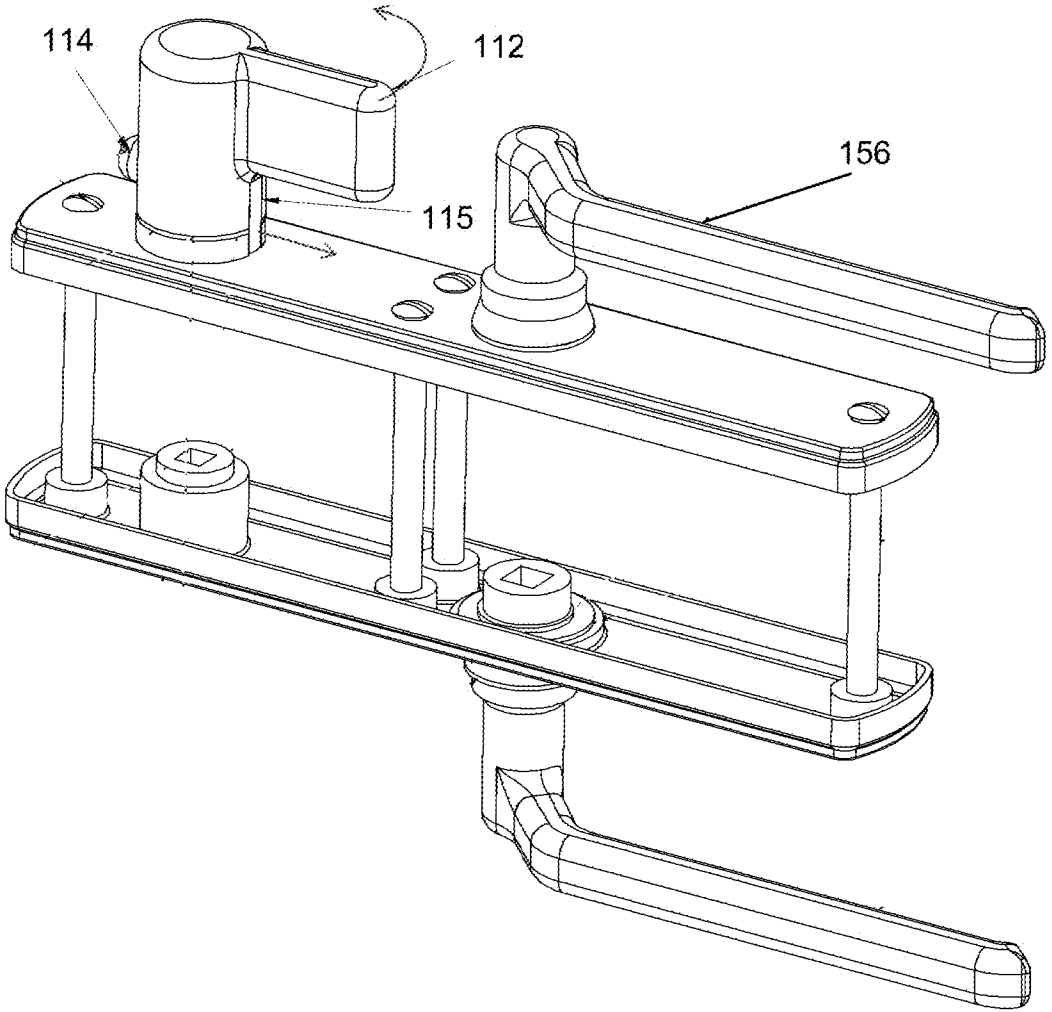
FIG. 6 is a view of a door handle escutcheon and lock control assembly.

Referring to FIG. 6, a view of the handle portion of the doors of FIGS. 1-4, and to FIG. 1, which illustrates the locked configuration, for unlocking, rotating clockwise a thumb lock control handle 112, which is attached to a thumb lock rod that passes through central drive shaft 70 causes locking gear 68 to rotate counterclockwise. The thumb lock handle has a locking button 114 defined therein which must be depressed to allow rotation of the thumb lock handle. As the thumb lock handle rotates, gear 68 rotating counterclockwise drives security bolt rack gear 72 which raises pin 64 out of locking pin slot 66, pulls security bolt 74 out of the receiver in the jamb above the door, and lowers the hook latch 76 out of engagement with the keeper (not shown)

defined in the door jamb. The door can then be opened by operation of the handle (or handles in the case of the dual door configuration) as discussed elsewhere. To lock the door, the reverse operation is performed, turning thumb lock control handle 112 clockwise, which rotates gear 68 clockwise, driving security bolt rack gear 72 upward, which moves latch 76 into engagement with the keeper, lowers pin 64 into slot 66, and drives security bolt 74 up into its receiver, thereby locking the door. Latch 115 will lock the thumb lock control handle 112, so that the handle will not rotate again until button 114 is depressed.

Figure 7:
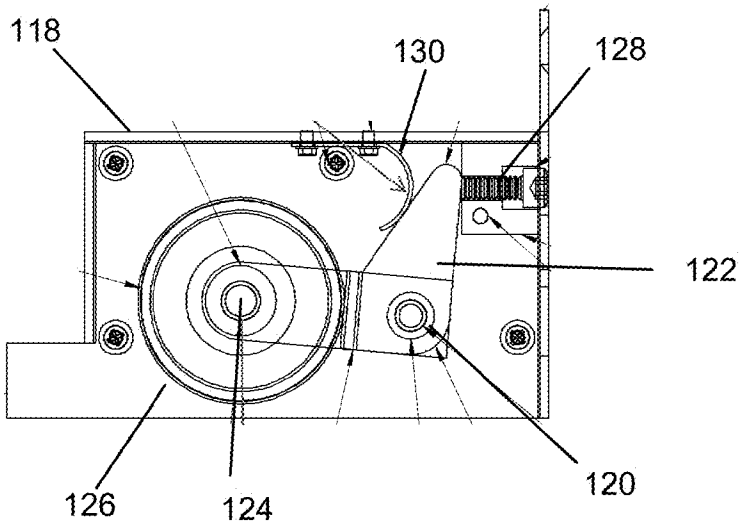
FIG. 7 is a view of an individual roller assembly.

Referring now to FIG. 7, a view of an individual roller assembly, the roller assembly 116 comprises a case 118 (such as case 20, for example) mounting a pivot shaft 120 which pivotally mounts an adjustment arm 122 and roller shaft 124. Roller shaft 124 rotationally supports the roller wheel 126. An adjustment screw 128 mounts to the case 118 and pushes against adjustment arm 122. Opposite the position where the adjustment screw pushes against the adjustment arm, a tension spring 130 pushes against the adjustment arm. Rotation of the adjustment screw causes rotation of the adjustment arm about shaft 120, thereby raising or lowering the wheel 126, which allows for adjustment of the height that the door is positioned on the roller track.

Figure 8:
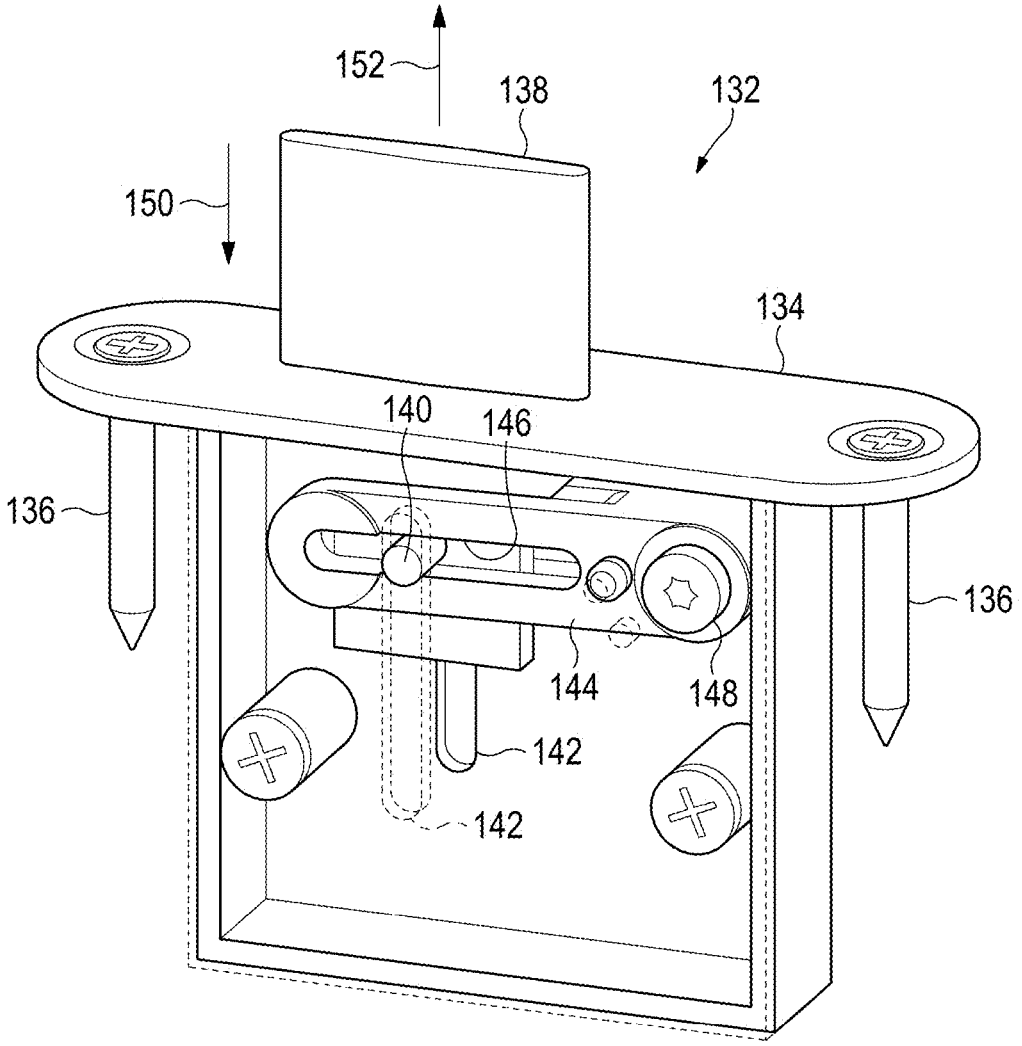
FIG. 8 is a view of an individual guide blade assembly.

Referring now to FIG. 8, a view of an individual guide blade assembly, the guide blade assembly 132 comprises a case 134 mounted to the top of the door via securement fasteners 136. A blade 138 carries a pin 140 at a lower portion thereof extending laterally out both sides of the blade, the pin traveling in vertical slots 142 defined in the case 134. A rotatable arm 144 is mounted in the case and includes a slot 146 therein, slot 146 also receiving pin 140 therein. A rotary drive 148, in the form of a star drive headed pin allows the arm 144 to be rotated. In operation, when installing the door or removing the door for maintenance purposes, the drive 148 is rotated counterclockwise, which via interaction of the pin and slots, causes blade 138 to retract down into the case in the direction of arrow 150. The top of the door is then no longer held in alignment with the slot in jamb above the door, so the door can be removed from position. Rotating the drive 148 clockwise causes blade 138 to extend in the direction of arrow 152. Thus, when installing the door, once the door is in position, the drive is rotated to extend the blade so that it interacts with the slot above the door, holding the door in position while still allowing the door to be moved.

Figure 9:
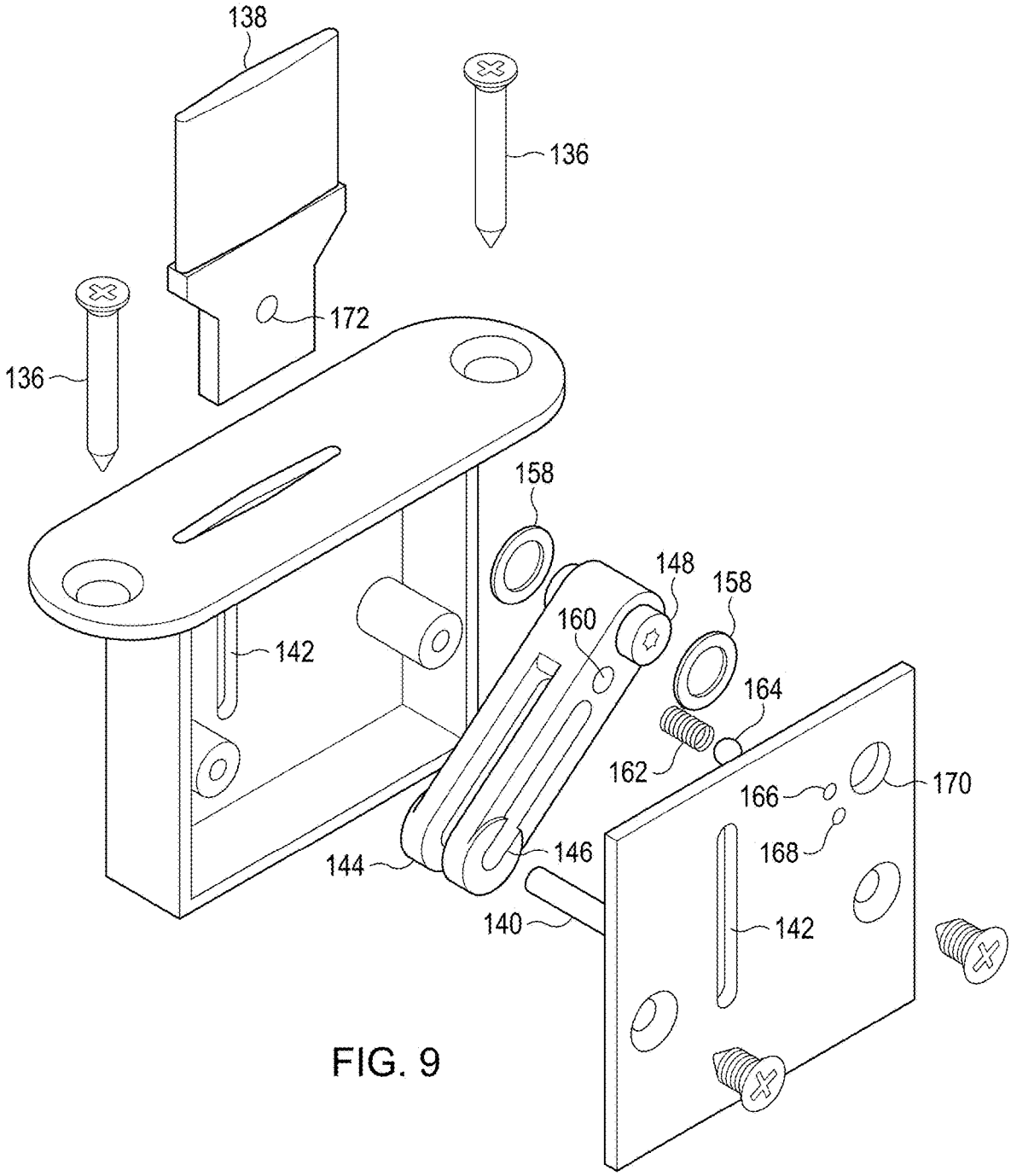
FIG. 9 is an exploded view of the guide blade assembly of FIG. 8.

FIG. 9 is an exploded view of the guide blade assembly of FIG. 8 wherein it may be observed that 2 washers 158 are positioned on protruding portions of rotatable arm 144, the protruding portions received in openings 170 on each side of the guide blade assembly to define the rotation point. An opening 160 is defined in the arm 144, receiving a spring 162 therein, with a ball bearing 164 positioned at the external end of the spring. Bearing receiving openings 166, 168 are defined in the face of the guide blade assembly, being of lesser diameter than the diameter of the bearing, defining an upper and lower detent that receive the ball bearing in use. The lower portion of blade 138 has an opening 172 through which pin 140 fits when the device is assembled.

Figure 11:
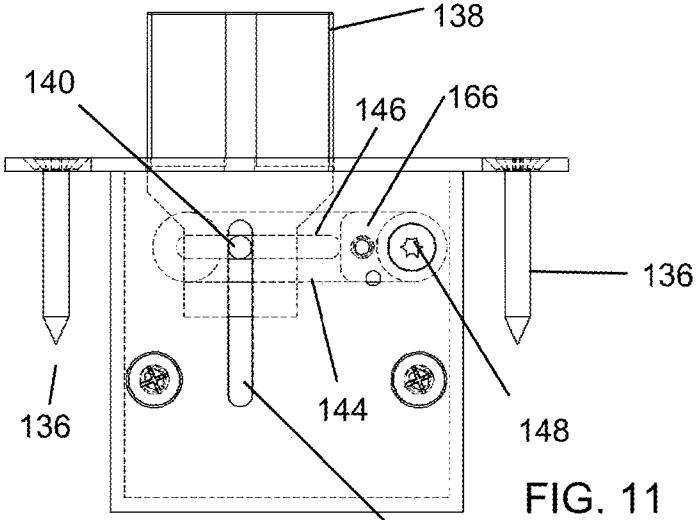
FIG. 11 is a side partially transparent view of the guide blade assembly with the blade extended.
Figure 10:
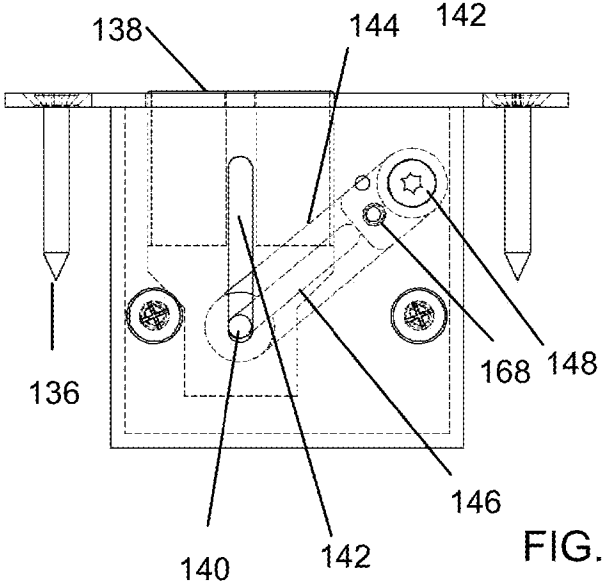
FIG. 10 is a side partially transparent view of the guide blade assembly with the blade retracted.

Referring now to FIG. 10, a side partially transparent view of the guide blade assembly with the blade 138 retracted, arm 144 is rotated to its lowest position (by counterclockwise turning of drive 148. The interaction of the pin 140 and slots 142, 146 results in the blade being pulled down to its retracted position. Bearing 164 seats in opening 168, keeping the blade retracted in absence of turning of drive 148. In FIG. 11, the blade is extended, by turning drive 148 clockwise, which raises the blade, and by rotation of the arm 144, causes bearing 164 to unseat from opening 168 and instead, seat in the upper opening 166. This holds the blade in the open position so that it doesn't inadvertently lower in absence of desired lowering by operation of drive 148.

The embodiments above illustrated gliding doors, but the concepts may be employed with lift glide windows also.

Figure 12:
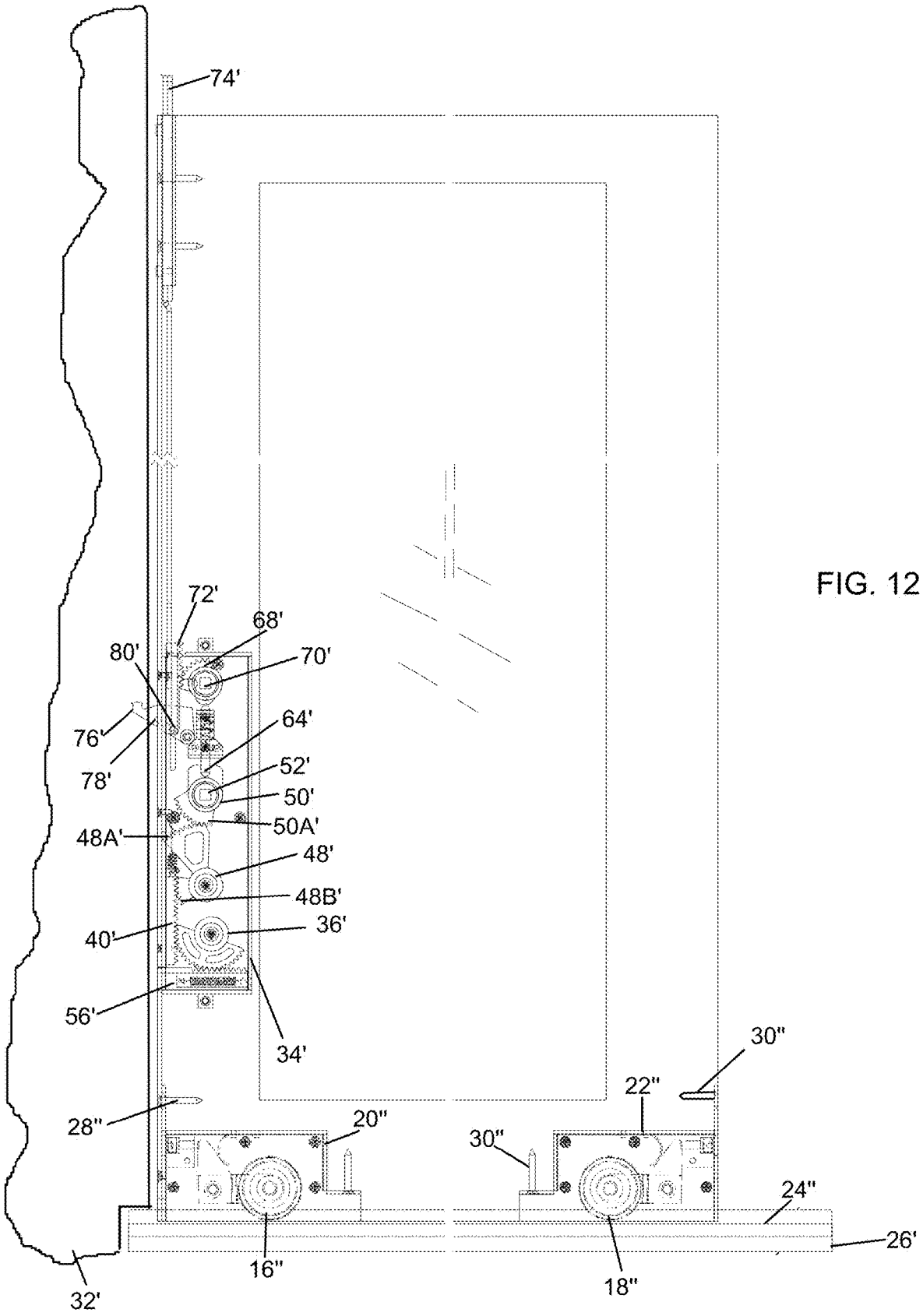
FIG. 12 is a view of a lift glide window lock assembly in a closed and locked configuration.
Figure 13:
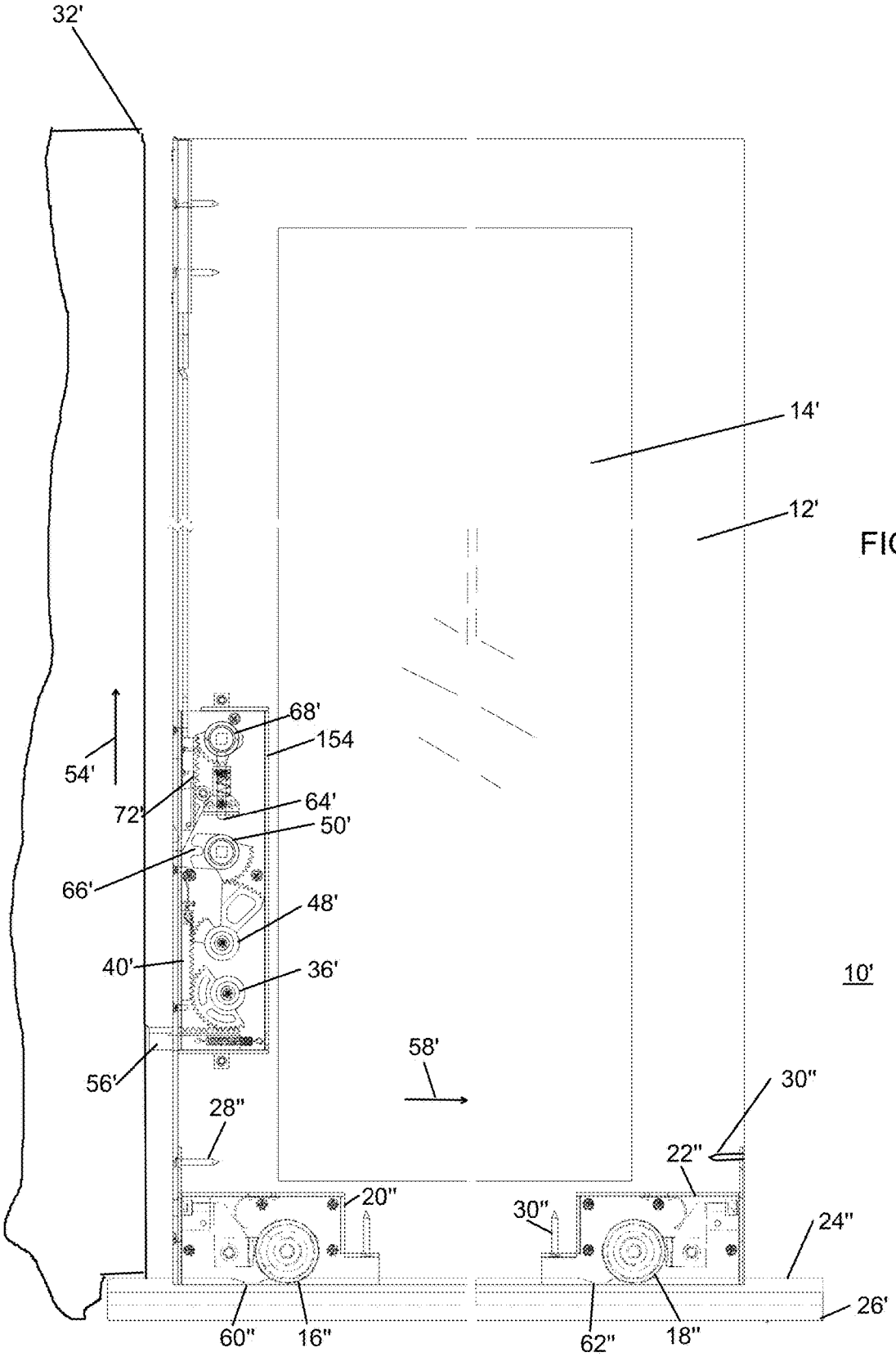
FIG. 13 is a side view of the lift glide window lock assembly in an open configuration.

Referring to FIG. 12, a side view of a lift glide window lock assembly in a closed and locked configuration, and FIG. 13, a side view of the lift glide window lock assembly in an open configuration, the configuration is similar to the door of FIGS. 1 and 2, but with some modifications. The window 10' comprises a frame 12', which is rectangular in shape in the illustrated embodiment, the frame supporting a glass panel 14'. Window operational hardware is mounted to the frame as will now be described. A left and right roller 16", 18" are rotationally supported in roller boxes 20", 22", mounted at the left and right lower ends of the window. The rollers are designed to fit over and roll on a roller track 24" mounted to the window sill 26'. In the window closed position, the rollers are seated within wells 60", 62" defined in the roller track, which allows the window to lower slightly as it closes, enabling engagement with a perimeter window seal. The roller boxes suitably fit within receiving portions defined in the window frame, and may be secured to the frame by fasteners 28", 30", which might comprise screws. The frame is constructed of wood or plastic or other suitable material that provides sufficient support and rigidity to operate as a window frame.

To the left of the window panel in FIG. 12, is a jamb 32', which may be defined as part of a wall in which the window opening is made. Along the left edge of the window, positioned above roller box 20", is a push pin/lift gear/latch case 154, which fits into the window in an opening sized to receive the push pin/lift gear/latch case. A push pin gear 36' is mounted within the push pin/lift gear/latch case, the teeth of the driving gear interacting with a push pin 56'. 42" The push pin/lift gear/latch case 34' holds therein a lift gear 48', and a drive gear 50'. Drive gear 50' receives a square cross section drive shaft 52' (which is driven by operation of an opening handle 156 (FIG. 6) to turn the drive gear counterclockwise for opening). A pair of guide blade assemblies corresponding to guide blades assemblies 132 of the door configuration may be provided at the top of the window to follow a track defined above the window, guiding the window as it moves.

Referring to FIGS. 12 and 13 together, rotation of the drive shaft 52' counterclockwise causes gear 50' to rotate, and the gear teeth 50A', which mesh with gear teeth 48A' of lift gear 48', are thereby driven in a clockwise direction, causing lower gear teeth 48B' to also rotate, which by interaction with push pin rack gear 40', causes the push pin rack gear to move upwardly in the direction of arrow 54'. The upward movement of the push pin rack gear causes rotating of push pin gear 36' clockwise, causing push pin 56' to extend towards the window jamb, thereby pushing against the jamb and urging the window to open towards the right, in the direction of arrow 58'.

The rollers 16", 18" are moved up out of the wells 60", 62", thus disengaging the entire perimeter weather seal allowing for immediate release of all weather seal contact, allowing the window to move freely with zero weather seal contact.

Locking of the window of FIGS. 12 and 13 is accomplished by a series of lock components, which include a spring loaded locking pin 64' adapted to be received into locking pin slot 66' defined in drive gear 50'. A locking gear 68' is positioned within push pin/lift gear/latch case 154, with central drive shaft 70' controlling rotation of the gear. The drive shaft is rotated by the turning of a thumb lock control handle. Locking gear 68' drives a security bolt rack gear 72' which is mounted to security bolt 74', bolt 74' extended upwardly to the top of the window and extending into a bolt receiving portion defined in the upper window jamb when in the locked position. A window latch 76' is pivotally mounted within the lift gear case, mounted to security bolt rack gear 72' by pin 80' which rides in slot 78' of the latch.

When in the locked configuration of FIG. 12, pin 64' is received in slot 66' of the drive gear 50', preventing the drive gear from turning and thereby preventing opening of the window. Latch 76' is extended and is engaging a keeper defined in the window jamb, further locking the window. Finally, security bolt 74' is extended into a receiver defined in the ceiling of the window jamb, further locking the window against movement.

To open the window, locking gear 68' is rotated by the counterclockwise rotation of drive shaft 70', causing the gears of locking gear 68 to pull rack gear 72' downwardly, thereby pulling security bolt 74' downwardly, causing pin 80' to move down which then travels in slot 78' to cause latch 76' to rotate counterclockwise and retract. Pin 64' is simultaneously pulled upwardly, out of engagement with slot 66' so that drive gear 50' can then rotate if desired.

Figure 14:
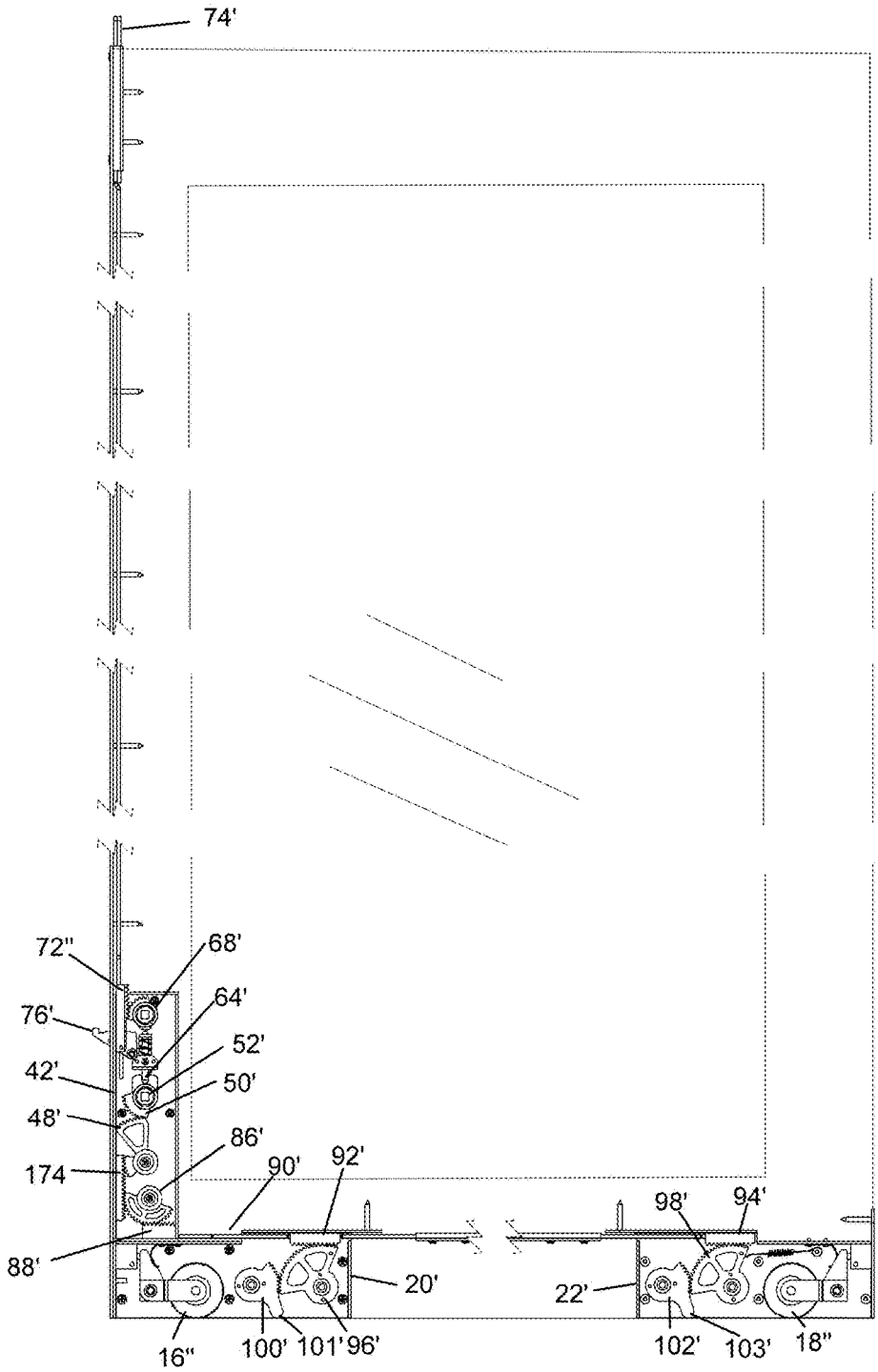
FIG. 14 is a side view of a dual lift glide window assembly in a closed and locked configuration.
Figure 15:
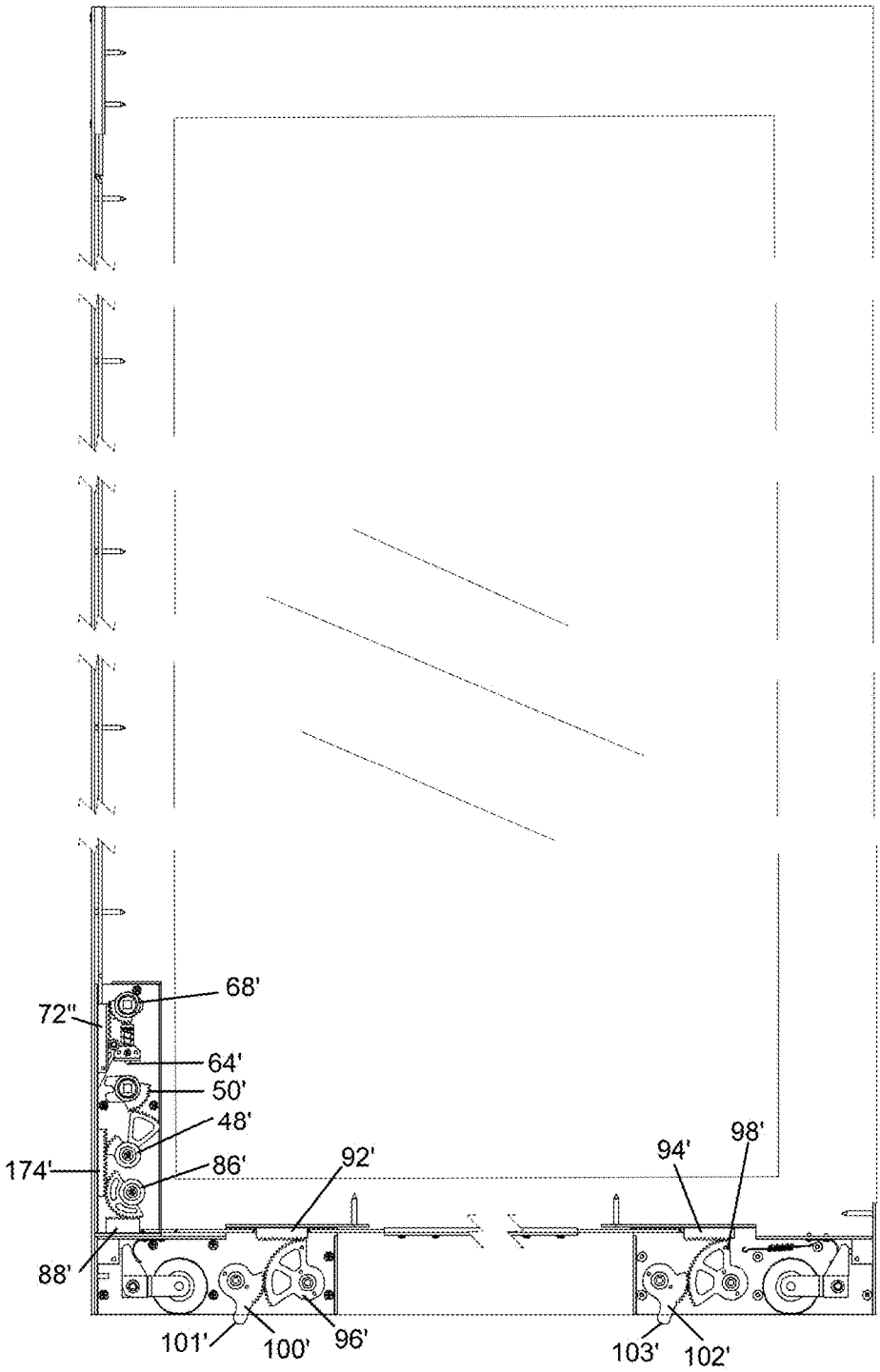
FIG. 15 is a side view of the dual lift glide window assembly in an open configuration.

A corresponding dual lift glide window assembly may also be provided as illustrated in FIGS. 14 and 15.

FIG. 14, a side view of a dual lift glide window assembly in a closed and locked configuration, and FIG. 15, in an opened position shows that the window employs corresponding components to those in the door configuration, but the transfer case function and locking assembly are provided in a single case with slight alteration to the components. The function of the pull bar rack gear 44 and the pull bar rack gear 84 is combined to a single pull bar rack gear 174 that drives both lift gear 48' and drive gear 86'.

The window employs pull bar rack gear 174 mounted to pull bar 42', which operates transfer gear 86'. Drive gear 86' interacts with horizontal rack gear 88' mounted on horizontal pull bar 90', positioned above left roller box 20'. Roller boxes 20' and 22' have rollers 16', 18' mounted therewithin, the rollers riding on roller track 24' in the door sill. A horizontal rack gear 92' and horizontal rack gear 94' are mounted to horizontal pull bar 90', at roller boxes 20', 22', and interact with power drive gears 96', 98' mounted in roller boxes 20', 22'. Power drive gears 96', 98' interact with counterpart gear teeth on motion gears 100', 102' inside the respective roller boxes. The motion gears have a push finger portion 101', 103'.

FIG. 15 is a side view of the dual lift glide window assembly in an open configuration. In this configuration, the locking mechanism is retracted so the window is free to glide, much in the manner of the door configuration.

In operation, the thumb lock control handle 112 being turned causes locking gear to turn clockwise which pushes the locking pin 64' into drive gear 50' (locking against opening movement of the door) and engages the security bolt rack gear 72' and moves the security bolt 174 up into a retaining bracket in the wall above the window. Simultaneously, the window latch 76' is rotated upwardly to engage a catch in the wall (not shown), locking the window. To unlock, the thumb lock is rotated in the opposite direction.

For rolling operation of the window, turning the opening handle 156 drives gear 50' counterclockwise, rotating lift gear 48' clockwise, engaging rack gear 174, which pulls the rack gear up. This rotates the transfer gear 86' clockwise, which engages the horizontal pull bar rack gear 88', simultaneously moving horizontal pull bar 90,' causing horizontal rack gears 92' and 94' to simultaneously engage power gears 96' and 98', moving them counter clockwise, which moves power gears 100', 102' clockwise, pushing the push finger portions 101', 103' against push pads mounted below the window, causing the window to lift and move (to the right in the view) along a track in the windows sill.

Figures 16A, 16B, 16C:
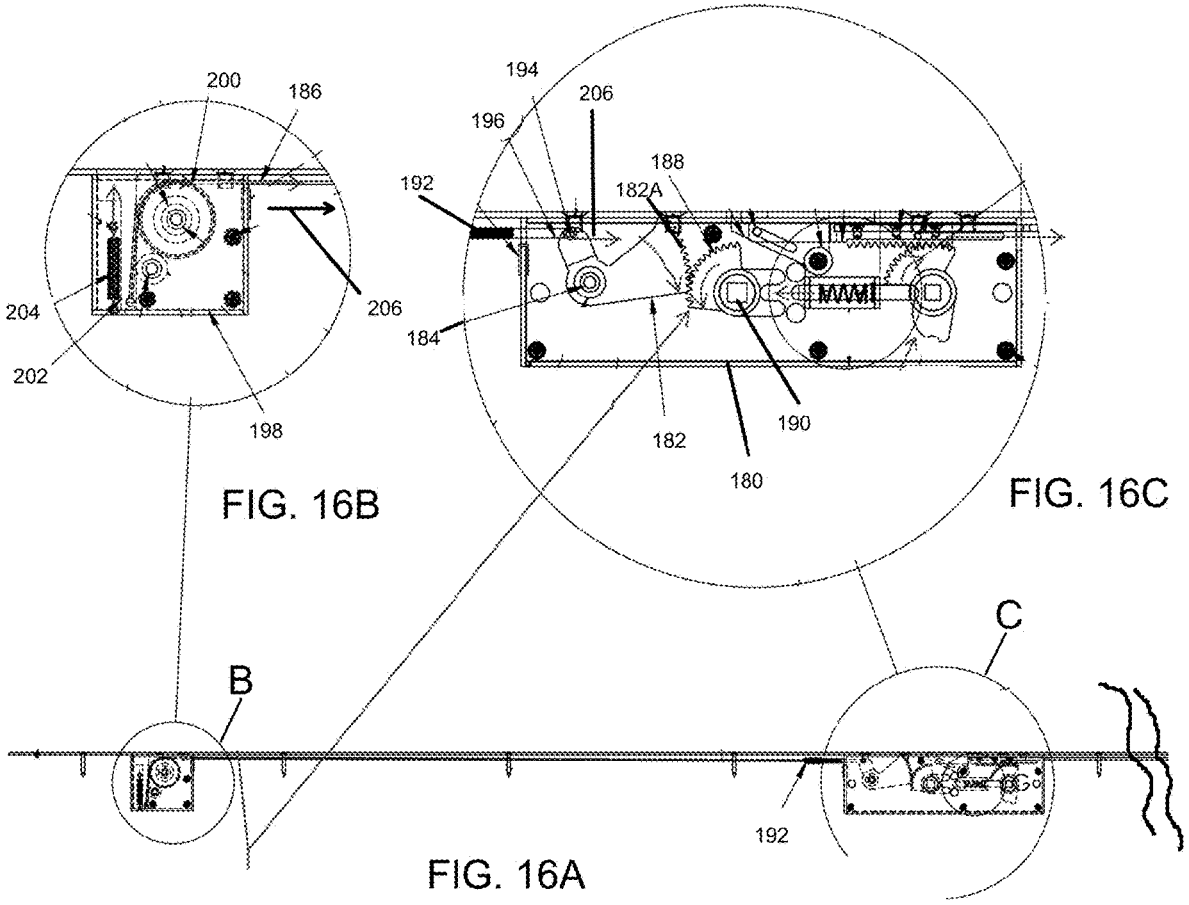
FIG. 16A is a side view of an alternative version of the door/window opening mechanism employing a cable linkage system.
FIG. 16B is an enlarged detail of the circle B of FIG. 16A.
FIG. 16C is an enlarged detail of the circle C of FIG. 16A.

An alternative version of the door opening mechanism employs a cable linkage system instead of the pull bar 42, and is described in connection with FIG. 16. Referring to FIG. 16, a side view of a lift glide door drive/lock assembly with cable drive, in a closed and unlocked configuration. The drive/lock comprises a lift mechanism case 180 enclosing components including a lift arm 182 which pivots on pivot mount 184 and attaches to a pull cable 186. The lift arm 182 carries gear teeth 182A at an upper end thereof. Gear teeth of a drive gear 188 mesh with gear teeth 182A and drive gear 188 is mounted to drive shaft 190, suitably a square cross section drive shaft (which is driven by operation of an opening handle to turn the drive gear counterclockwise for opening operation). The cable 186 mounts to the lift arm via a latch pin 194 mounted by a pivot rod 196 to the lift arm at an upper end of the rod. The lower end of the rod carries a cable adjuster 192 which cradles the cable 186. The cable adjuster lengthens or shortens to allow adjusting of the cable tension to remove any slack in the cable on assembly or during long term use of the device. The cable extends down towards the lower portion of the door/window.

Lower on the door (or window) from the mechanism case is push pin drive case 198, which mounts push pin pulley 200 therein. Pull cable 186 enters the upper portion of case 198 and is received on the pulley to achieve an approximately 90 degree turn of the run of the cable. The end of cable mounts to an end of push pin 202 away from the outer edge of the door/window. A return spring member 204 urges the push pin to a retracted (into the drive case 198) position in absence of actuation by pulling of the cable.

In operation, rotation of the door handle causes drive shaft 190 to turn drive gear 188 counterclockwise and meshing with gears 182A causes lift arm 182 to rotate clockwise on pivot mount 184, pulling latch pin 194 and pivot rod 196 in the direction of arrow 206. The pulley 200 translates the movement of the cable into a pulling action against the rear end of push pin 202, moving the push pin outwardly in the direction of arrow 208 (which pushes the push pin against the door/window jamb, urging the door/window towards an open position). On release of the handle, the action of spring member 204 will retract the push pin and cable, reversing the motion of lift arm 182 and the interaction of the gears.

The cable 186 is suitably a metal cable, but other options can be employed, such as synthetic cables or rope.

A guide member may also be provided for the push pin to discourage it from pulling upwardly with motion of the cable, so that the push pin moves horizontally outwardly with minimal off of horizontal axis movement.

The configuration of FIG. 16 provides some advantages over the non-cable versions of the door/window mechanism, including additional length of travel of the push pin (up to ⅛th inch in a particular embodiment). Further, easier assembly and lower component cost is provided with the elimination of 3 gear/rack meshings.

The locking mechanisms and upper security bolt operation of this configuration correspond to those of the other door/window mechanism configurations and are not further described in FIG. 16.

The operational mechanisms of the present disclosure can be scaled upward or downward to accommodate heavier or lighter doors and windows. Larger size doors and windows will weigh more, so the various gears and components can be sized to allow operation of the door/window without requiring big force or strength from the user.

While multiple embodiments of the technology have been shown and described, it will be apparent to those skilled in the art that many changes and modifications may be made without departing from the broader aspects. The appended claims are therefore intended to cover all such changes and modifications as fall within the true spirit and scope of the technology.

What is claimed is:

1. Hardware for operating a gliding door or window comprising:

an opening mechanism for controlling actuation of an opening operation; and an urging member for urging the gliding door or window towards an open position, wherein the opening mechanism interacts with the urging member by use of a cable drive system, wherein said opening mechanism comprises a user operable handle that actuates a drive member, wherein said drive member actuation pulls said cable drive system, wherein said cable drive system connects to said drive member at a first end of a lift cable that comprises the cable drive system and to an actuator that comprises the urging member at a second end of the lift cable, said actuator extending on operation of the opening mechanism to push against a surface to urge the door or window toward an open position, wherein a push pad is provided at a jamb position for said actuator to push against, and wherein said push pad is located at a position below a bottom edge of the door or window.

2. The hardware according to claim 1 further comprising:

a drive gear rotated by operation of the handle, the lift cable interactive with said drive gear via said drive member to move, the actuator interactive with said lift cable to extend by operation of the drive gear and the lift cable to push against a brace surface to urge the door or window towards an open position.

3. Hardware for operating a gliding door or window comprising:

an opening handle for allowing an opening operation to be performed; and an urging mechanism for urging the gliding door or window towards an open position upon actuation of the opening handle, said urging mechanism and interconnected via a cable member, said urging mechanism comprising a push pad located at a position below a bottom edge of the door or window and a rotary actuator that rotates to push against the push pad for moving the door or window towards an open position when the opening operation is performed.

4. The hardware according to claim 3 further comprising:

the opening handle is operable by a user for starting the opening operation;

a drive gear rotated by operation of the handle, a cable member interactive with said drive gear to move, wherein said rotary actuator is interactive with said cable member to rotate by operation of the drive gear and the cable member to push against the push pad.

5. The hardware according to claim 3 wherein said gliding door or window comprises plural glide wheels enabling said door or window to move on a track, said track comprising at least one well for at least one of said plural glide wheels, said at least one well receiving the at least one glide wheel therein when the door or window is in a closed position.

6. The hardware according to claim 3 further comprising at least one guide blade positioned at a top of said door or window for traveling in a slot defined above the door or window for guiding the upper portion of the door or window when opening or closing.

* * * * *